US006269845B1

(12) United States Patent
Scirbona et al.

(10) Patent No.: US 6,269,845 B1
(45) Date of Patent: Aug. 7, 2001

(54) WIRE WRAPPING AND UNWRAPPING TOOL

(76) Inventors: Edward Scirbona, 36 Lilac La., Danbury, CT (US); Edward Bazayev, 119-20 Union Turnpike-#E4B2, Kew Garden, NY (US) 11415; Sergey Baykov, 84-06 109$^{th}$ St., Apt. 4F, Richmond Hill, NY (US) 11418

( * ) Notice: Subject to any disclaimer, the term of this patent is extended or adjusted under 35 U.S.C. 154(b) by 0 days.

(21) Appl. No.: 09/483,929

(22) Filed: Jan. 18, 2000

(51) Int. Cl.$^{7}$ ..... B21F 3/04
(52) U.S. Cl. ..... 140/122; 140/124
(58) Field of Search ..... 140/122, 123, 140/124; 279/51; 310/50

(56) References Cited

U.S. PATENT DOCUMENTS 3,070,380 * 12/1962 Holmberg ..... 279/51
3,403,440 * 10/1968 Omori et al. ..... 310/50
3,440,465 * 4/1969 Pratt et al. ..... 310/50
3,799,561 * 3/1974 Humbert ..... 279/51
4,835,410 * 5/1989 Bhagwat et al. ..... 310/50
5,245,749 * 9/1993 Couch, Jr. ..... 140/124

* cited by examiner

*Primary Examiner*—Lowell A. Larson

(57) ABSTRACT

A tool capable of wrapping and unwrapping wires on terminals is provided with a quick-release mechanism to allow rapid and simple replacements of bits and sleeves used for the wrapping and unwrapping functions. This feature uses a bit driver comprising a camming surface that cooperates with a collet having a tapered split end for holding the bit and sleeve loosely or a gripping relationship for driving the bit. A novel bit/sleeve combination is capable of wrapping wires on terminals when rotated in one direction and unwrapping wires from terminals when rotated in the opposite direction. The tool also features a motor reversing switch for allowing the tool to be used both for wrapping and for unwrapping wires, with the reversing switch located in a protected region at the rear of the tool to prevent accidental activation. The same tool housing can also be used for fabricating both battery operated as well as AC operated tools.

6 Claims, 7 Drawing Sheets

WIRE WRAPPING AND UNWRAPPING TOOL

BACKGROUND OF THE INVENTION

Wire wrapping tools are well known in the art and are commonly used nowadays for the making of connections to terminals on a printed circuit board (PCB). See, for example, U.S. Pat. Nos. 4,177,555 and 4,194,700, whose contents are herein incorporated by reference, as examples of such tools. The wrapping tool wraps the wire around a sharp-cornered terminal which crushes any oxide layer between the terminal and wire and providing a tightly-held oxide-free metal-to-metal contact of the wire to the terminal. The typical tool is a wire-wrapping gun containing what is known as a removable bit and sleeve. The latter is typically fixed, and the bit rotates, usually clockwise (CW), within the sleeve. Wire from a spool, for example, is fed through the sleeve to the bit face. The bit has a bore for receiving the terminal, and when the bit is rotated around the terminal, structure on the bit face grabs the wire and wraps it around the terminal. The bit and sleeve are replaceably held on the tool by a front-facing collet which when tightened holds the sleeve within the tool. The bit is held in place within the sleeve by a shoulder on the bit. Replacement of the bit and sleeve is accomplished by loosening of the collet to release the bit and sleeve so it can be removed and replaced. Reasons for replacing include wrapping on a different size of terminal.

Tools also exist for unwrapping a wrapped wire from a terminal. A typical tool has a spiral groove cut into the end of an unwrap bit. When the unwrap bit is rotated counter-clockwise (CCW) on the terminal, the bit face grabs the end of the wire and feeds it into the spiral groove allowing it to be unwrapped from the terminal. See U.S. Pat. No. 4,064,581, whose contents are herein incorporated by reference, which describes a hand tool having a wrapping bit at one end and an unwrapping bit at the opposite end. Using a gun-type power tool for wrapping and unwrapping requires that a first bit and sleeve is used for wrapping, and to unwrap the first bit and sleeve must be removed and replaced by an unwrap bit and sleeve that acts as a bushing for the bit, and the power tool must be capable of both CW and CCW operation.

SUMMARY OF THE INVENTION

It is therefore an object of the invention to provide an improved tool capable of wrapping and unwrapping wires on terminals.

Another object of the invention is a tool provided with a quick-release mechanism to allow rapid and simple replacements of bits and sleeves.

Still another object of the invention is a novel bit/sleeve combination capable of wrapping wires on terminals when rotated in one direction and unwrapping wires from terminals when rotated in the opposite direction.

In accordance with a first aspect of the invention, the tool of the invention features a quick-release for the bit/sleeve.

In a preferred embodiment, a bit driver comprises an outwardly facing concave surface that cooperates with a collet having a tapered split end adapted to engage the concave surface and held in loose engagement therewith by a biasable collet housing in a first position. When the collet housing is moved to a second position, it is biased toward the collet and the collet's tapered split end is cammed by the concave surface into a gripping relationship with a sleeve tightly holding the sleeve on the tool while the bit is driven. To release the bit and sleeve it is merely necessary to move the collet holder from its second to its first position, which preferably is accomplished by rotation of the holder no more than 30°.

In accordance with a second aspect of the invention, the tool of the invention features a motor reversing switch for allowing the tool to be used both for wrapping and for unwrapping wires.

In a preferred embodiment, the reversible switch is located in a protected region at the rear of the tool to prevent accidental activation.

In accordance with a third aspect of the invention, the tool of the invention features a novel bit/sleeve construction that allows the same combination to be used for unwrapping or for wrapping wires without having to replace the bit or sleeve.

In a preferred embodiment the combined wrap/unwrap bit/sleeve comprises a bit having a bit face that will wrap around a terminal a wire fed to it through the sleeve and also provided adjacent the bit face with a helical groove capable when exposed of unwrapping a wrapped wire, a sleeve within which the bit rotates, and an adaptor or sleeve extension surrounding the sleeve and cooperating with the sleeve to hold it in either if two positions, a first position when the sleeve projects forward over the bit face and surrounding the helical groove and can provide the usual sleeve function of feeding a wire to the bit face during wrapping, and a second position when the sleeve is moved rearward to expose the helical groove allowing it to carry out its unwrap function.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention, like reference numerals or letters signifying the same or similar components.

DETAILED DESCRIPTION OF THE PREFERRED EMBODIMENTS

Figure 1:
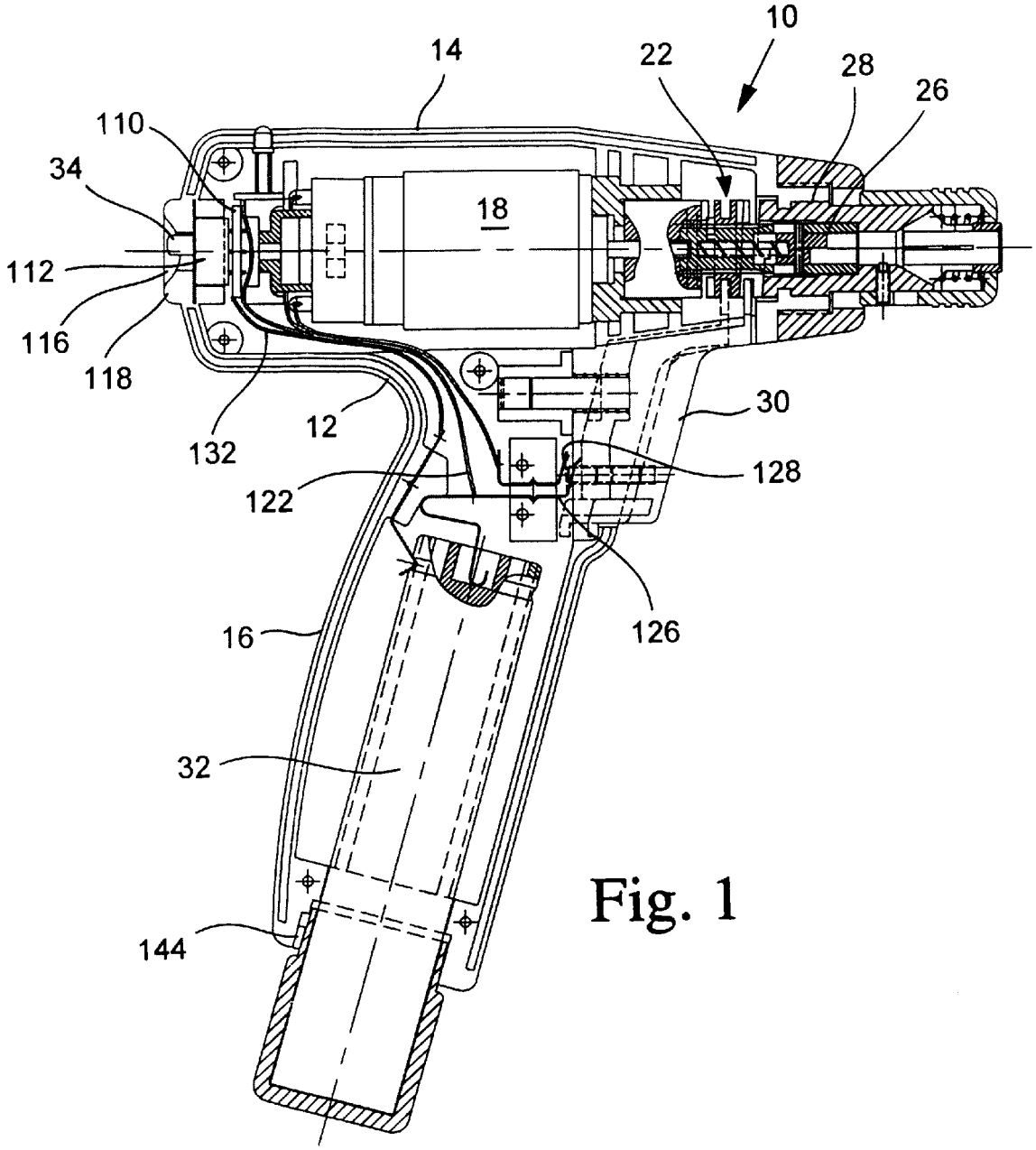
FIG. 1 is a partly cross-sectional side view of one form of wrapping/unmwrapping tool according to the invention.
Figure 2:
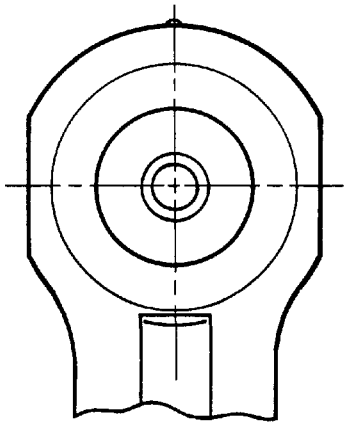
FIG. 2 is a partial front view of the tool of FIG. 1.

A wrapping/unwrapping tool 10 according to one form of the invention is shown in FIG. 1. It includes a gun-type housing 12 comprising a main body 14 supported on a handle 16. An electric motor 18 drives a bit 20 via a known gear system 22. The bit end, which has a flat 24 (FIG. 3), sits in a drive member 26 mounted for rotation within a fixed collet bushing 28. The motor and drive gear assembly are conventional and not part of the present invention. The motor 18 is activated by a trigger 30 which when pulled closes a circuit which includes a battery power source 32 and a reversing switch 34 at the rear of the housing 12.

Figure 5:
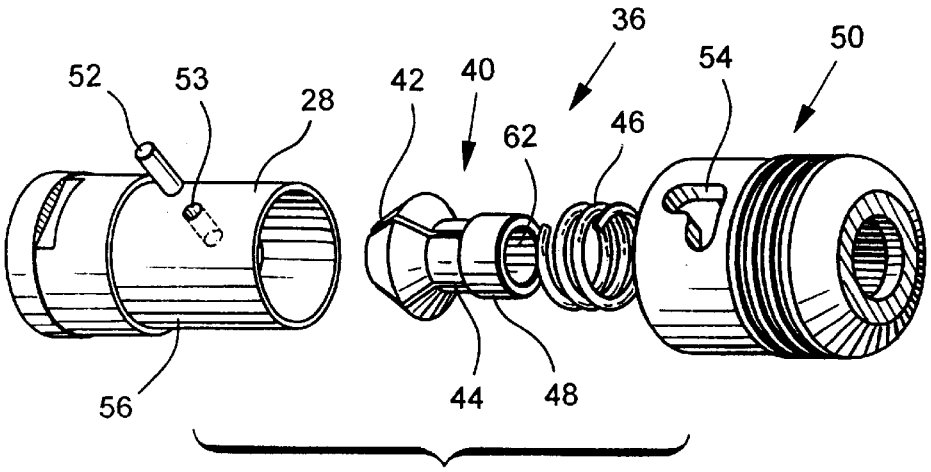
FIG. 5 is exploded perspective view of the quick-release mechanism of the tool illustrated in FIG. 1.
Figure 6:
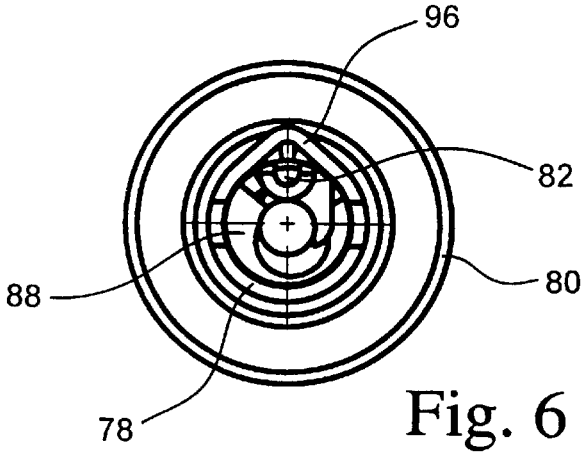
FIG. 6 is a front view of the bit face of a combined wrap/unwrap bit/sleeve according to the invention.
Figure 7:
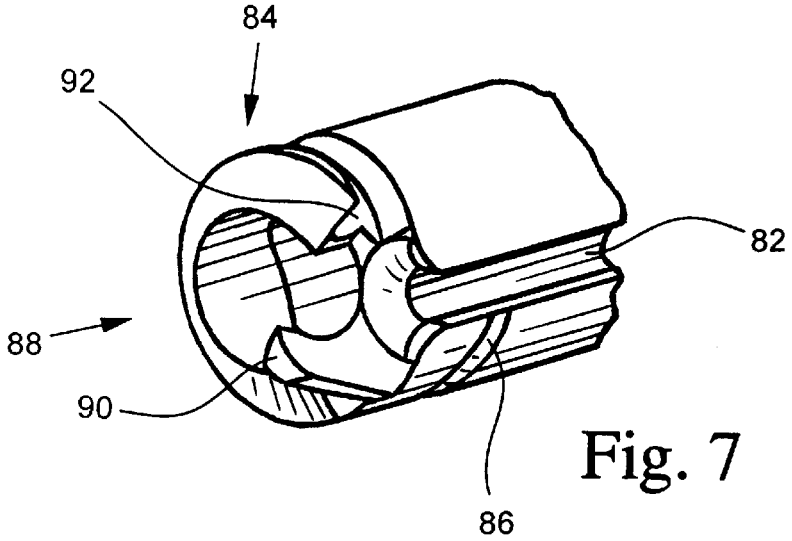
FIG. 7 is a perspective view and FIG. 8 is a side view of just the bit end of the combined wrap/unwrap bit/sleeve of FIG. 6.
Figure 8:
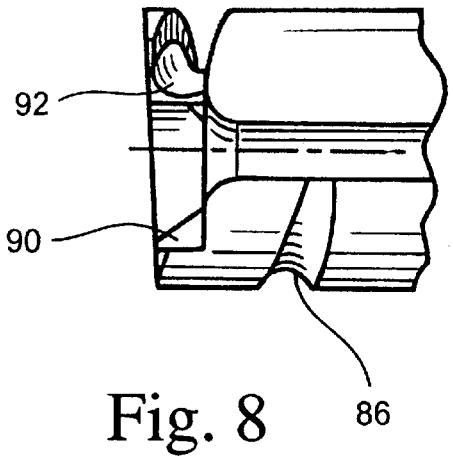

A quick-release mechanism 36 for the bit and sleeve is shown in FIG. 5. It comprises the collet bushing 28 having an interior concave—preferably tapered—forwardly-facing camming surface 38 (FIG. 3); a collet 40 having a tapered split end 42, serving as collet jaws, configured with a rearwardly-facing taper to engage the camming surface 38 on the bushing 28, a recessed region 44 for receiving a compression spring 46 and a forward cylindrical part 48; and a collet housing 50. The collet bushing 28 is mounted to the housing main body 14, the spring 46 mounts in the recessed region 44 of the collet 40, and the collet housing 50 is mounted on the collet bushing 28 by means of a pin 52 secured to the bushing side 28 via an opening 53 and engaging a right-angle slot 54 in the side of the collet housing 50. As is evident from FIG. 3, the interior of the collet housing 50 closely surrounds the exterior 56 of the bushing 28, the collet 40 is seated in the space inside the collet housing 50, and the spring 46 biases the collet 40 toward bushing 28 by a rim 58 on the collet housing 50. A sleeve 60 is received by a bore 62 in the collet 40 and a concentric bore 64 in the bushing 28. As usual, a bit 20 is rotatably mounted within the sleeve 60, and is held axially by a shoulder 66.

Figure 3:
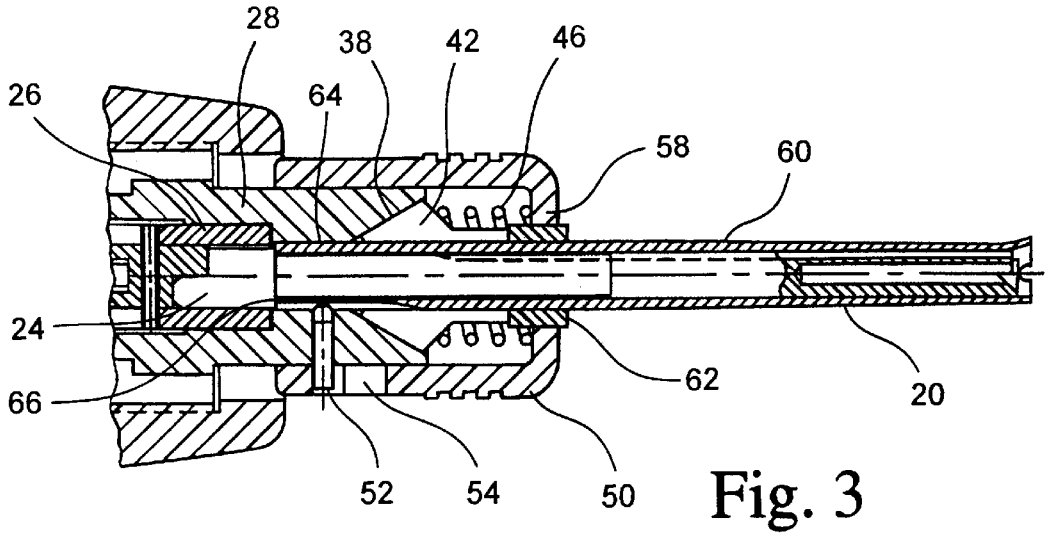
FIG. 3 is a partial view of the tool of FIG. 1 shown with a bit/sleeve loosely mounted for removal within the tool.
Figure 4:
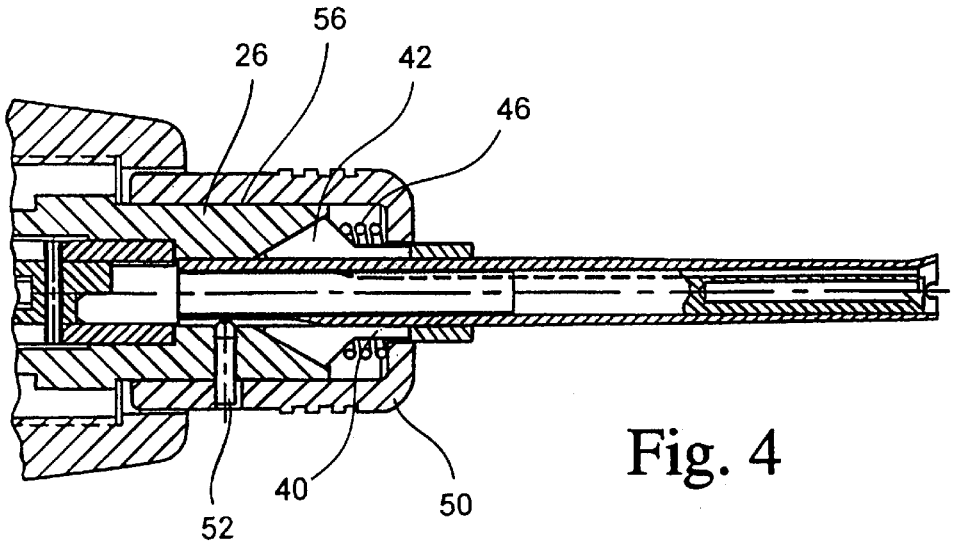
FIG. 4 is a partial view of the tool of FIG. 1 shown with a bit/sleeve tightly mounted within the tool ready for use.
Figure 12A:
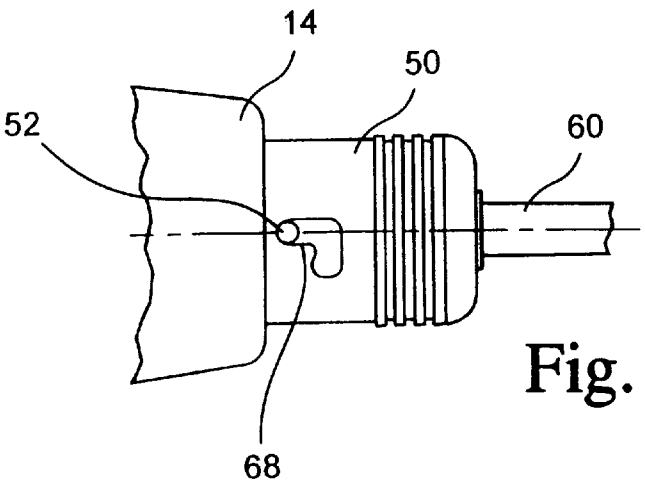
FIG. 12A shows it in its loosened position.
Figure 12:
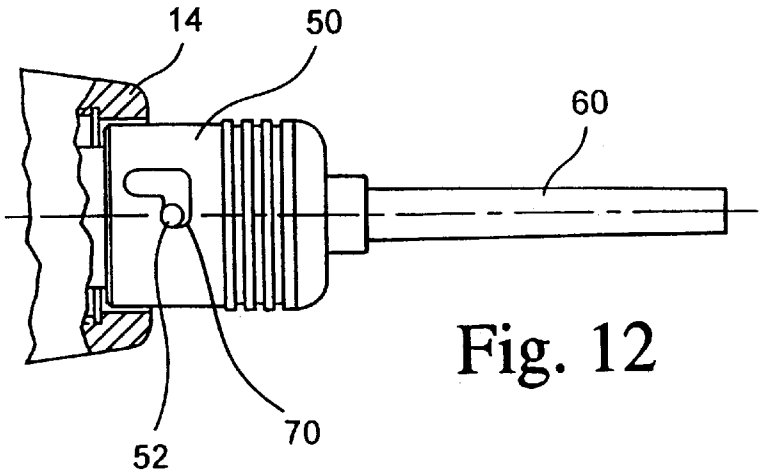
FIG. 12 is a partial side view showing the quick-release mechanism of the tool illustrated in FIG. 1 in its tightened position.

FIG. 3 shows the collet housing 50 in its first bit/sleeve release position, with the collet housing projecting forward by the action of the compression spring 46. The pin 52 is in a longitudinal portion 68 of its slot 54 (FIG. 12A), with the slot portion 68 closed off by a wall as a stop position for the pin 52. In this position, only a small spring pressure is exerted on the collet split end 42 and the slotted collet jaws 42 remain open allowing the bit and sleeve to be removed from the tool. FIGS. 4 and 12 show the collet housing 50 in its second bit/sleeve gripping position, with the collet housing forced into the tool housing against the compression spring 46 pressure. This is achieved by simply pushing and rotating the collet housing 50 CW about 15° relative to the bushing 28 until the pin 52 is moved into a lateral portion 70 of its slot 54 and locks in that position by the closed end of the slot wall. This action forces the collet tapered split end 42 tightly against the concave surface 38 of the bushing 28 closing the collet jaws tightly against the sleeve 60 gripping it tightly and preventing rotation. Now, when a wire is fed into the sleeve in the normal manner until the free end reaches the bit face, the bit pushed onto a terminal, and the motor activated, the wire will be wrapped around the terminal in the normal manner. To remove the bit/sleeve, the collet housing 50 is rotated CCW about 15° relative to the bushing 28 until the pin 52 is moved back into the longitudinal portion 68 of its slot 54 relieving the spring pressure which allows the collet jaws to relax and allows the bit/sleeve to be removed.

A conventional wrapping bit and sleeve or unwrapping bit can be used in this aspect of the invention, or the novel combined wrapping/unwrapping bit/sleeve of FIGS. 6–11 according to the invention can be used.

Figure 9:
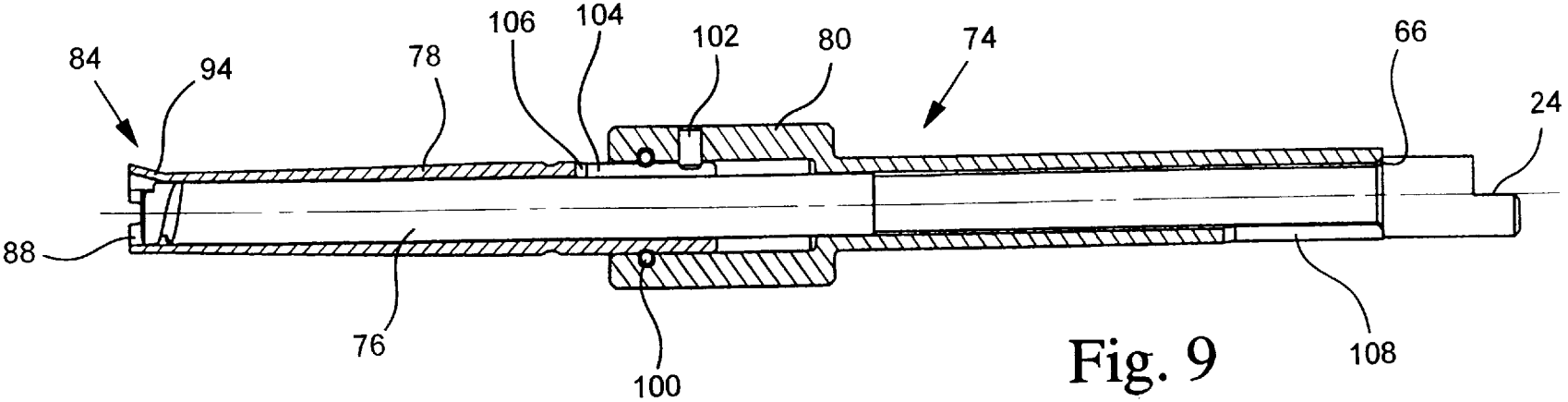
FIG. 9 is a cross-sectional side view of the combined wrap/unwrap bit/sleeve assembly of FIG. 6 shown in its wrap position and FIG. 10 is a similar side view showing it in its unwrap position.

As explained earlier, the combined wrapping/unwrapping bit/sleeve of the invention allows both the wrapping and unwrapping functions to occur without removing the bit/sleeve from its mounted position in the tool. The wrap/unwrap bit/sleeve assembly 74 (FIG. 11) comprises a bit 76, a shortened, axially-movable sleeve 78, and an adaptor or sleeve extension 80 whose position relative to the sleeve 78 controls whether the combination can wrap or unwrap. The back end of the bit 76 is conventional with the flat 24 and shoulder 66. The groove 82 is for the wire to be wrapped. The bit working end 84 at the left has an outer helical groove 86 configured when exposed for grabbing the wrapped wire end and unwrapping it. The bit face 88 is configured similarly to existing bit faces in that it has structure 90 for pushing a wire fed along the groove 82 forward and then coiling it around a terminal when the bit is rotated CW. The helical groove end 92 which terminates at the bit face does not interfere with the wrapping action because, during operation, as illustrated in FIG. 9, the sleeve end 94 overlies the bit face 88 and covers the helical groove 92. Moreover, the bit is rotating CW so that the feeding wire which exits the sleeve 78 via a spout 96 has no opportunity for entering the groove beginning at 92. The sleeve 78 is maintained in a first position for wire wrapping as shown in FIG. 9 by a first groove 98 engaging an O-ring 100 mounted on the inside of the adaptor 80. A pin 102 mounted in the side of the adaptor 80 rides in a slot 104 and prevents rotation of the sleeve 78.

Figure 10:
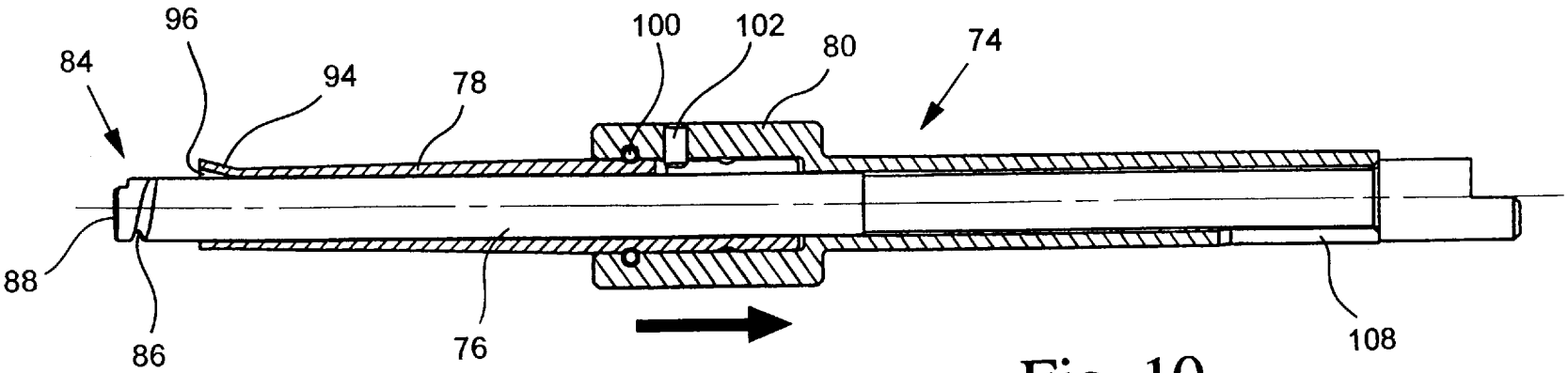
Figure 11:
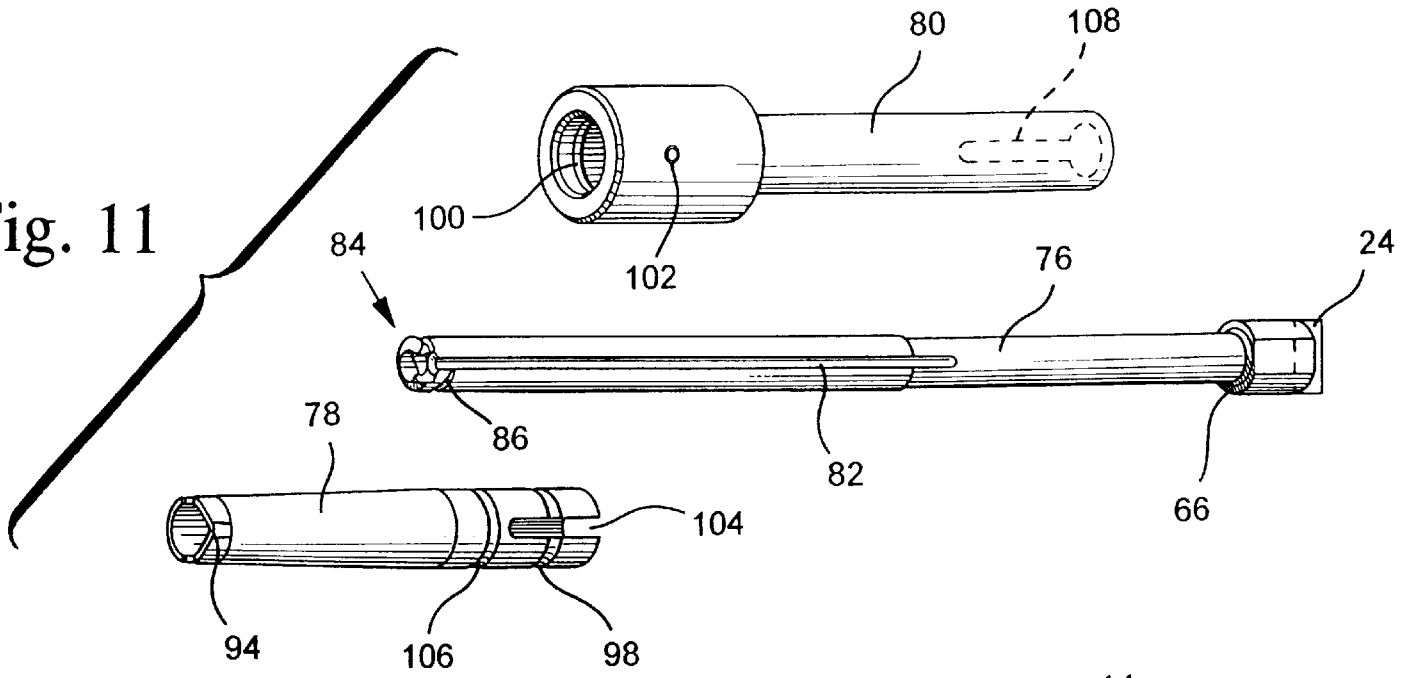
FIG. 11 is exploded perspective view of the combined wrap/unwrap bit/sleeve assembly of FIG. 6.

When the user desires to exercise the unwrap function, the sleeve 78 is simply pushed rearward in a linear motion until a second groove 106 is engaged by the O-ring 100 retaining the sleeve in its second position as shown in FIG. 10. The right end of the adaptor 80 is against the bit shoulder 66 preventing movement of the adaptor. This action exposes the helical groove 86. Now, when the bit is rotated CCW, the exposed end 92 of the spiral groove is capable of grabbing the wire end and unwrapping it from its terminal. The slot 108 at the rear of the adaptor 80 allows entrance of the feeding wire into the longitudal groove 82 of the bit during the wrapping function. The spiral groove behaves during its unwrapping function similar to the manner in which the known unwrap tool operates. Similarly, the bit face when rotated CW behaves during its wrapping function similar to the manner in which the known wrap tool operates.

Figure 13:
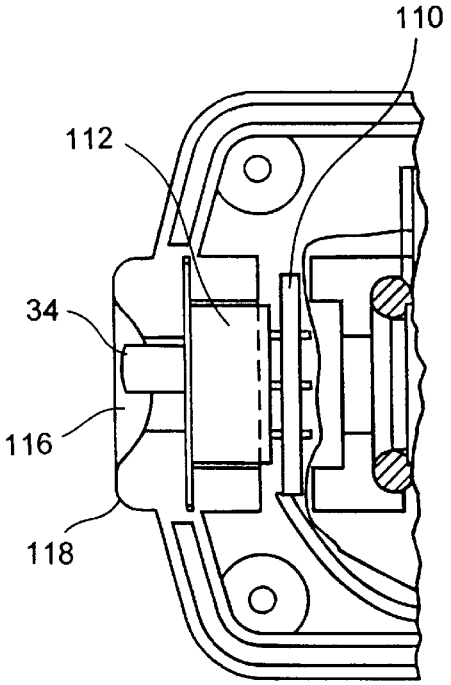
FIG. 13 is an enlarged side partly cross-sectional view of the rear end of the tool of FIG. 1 showing the protected mounting of the reversing switch in a first position and FIG. 14 shows it in its second position.
Figure 14:
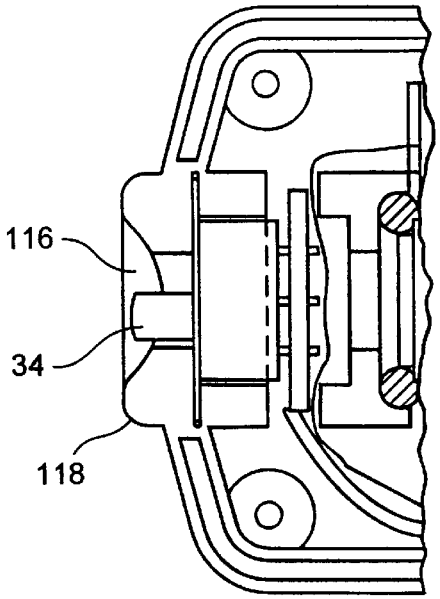
Figure 15:
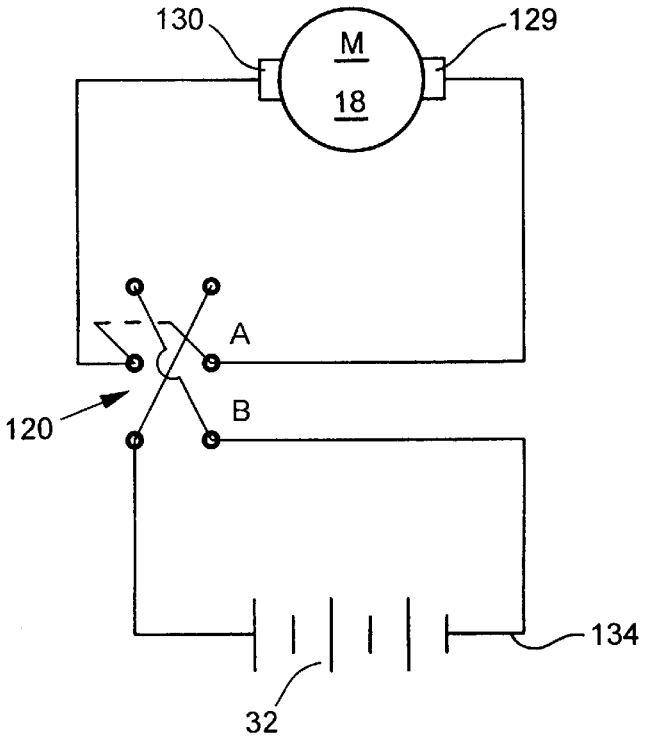
FIG. 15 is a partial circuit schematic showing how reverse motor operation can be achieved.

As is clear from the foregoing, for use with the combined wrap/unwrap bit/sleeve, it is desirable for the tool 10 to be capable of both CW and CCW rotation. A DC motor 18 can be incorporated with that capability provided that a circuit and switch are provided that will, in effect, reverse the polarity of the operating voltage applied to the motor terminals. A further feature of the present invention is to provide the circuit and the operating reversing switch in a protected position so that it cannot be accidentally activated when the tool accidentally hits a hard surface or is placed down on a hard surface so as to activate the switch. In a preferred embodiment, the circuit is provided on a small circuit board 110 mounted at the rear behind the motor 18, and the reversing switch 112 which cooperates with the circuit to control the rotation direction of the motor is mounted on the tool housing 14 at its rear, behind the circuit board 110 and in a recessed region 116 molded into the housing 14. Reference 34 refers to the switch activator button which can be moved from an upper position as shown in FIG. 13 for CW rotation, to a lower position as shown in FIG. 14 for CCW rotation. The switch body 112 is preferably mounted on the circuit board 110. The recessed region 116, as shown, is provided by an annular ridge 118 whose height parallel to the tool axis and in a direction away from the tool exceeds that of the switch button 34, preventing the latter from being accidentally activated. The location of the switch 34 at the rear makes it very convenient for the user to change motor rotation by using the thumb on the hand holding the gun to operate the switch. FIG. 15 is a circuit schematic of one form of circuit that can be used to reverse motor rotation with a simple double pole/double throw switch 120.

Figure 16:
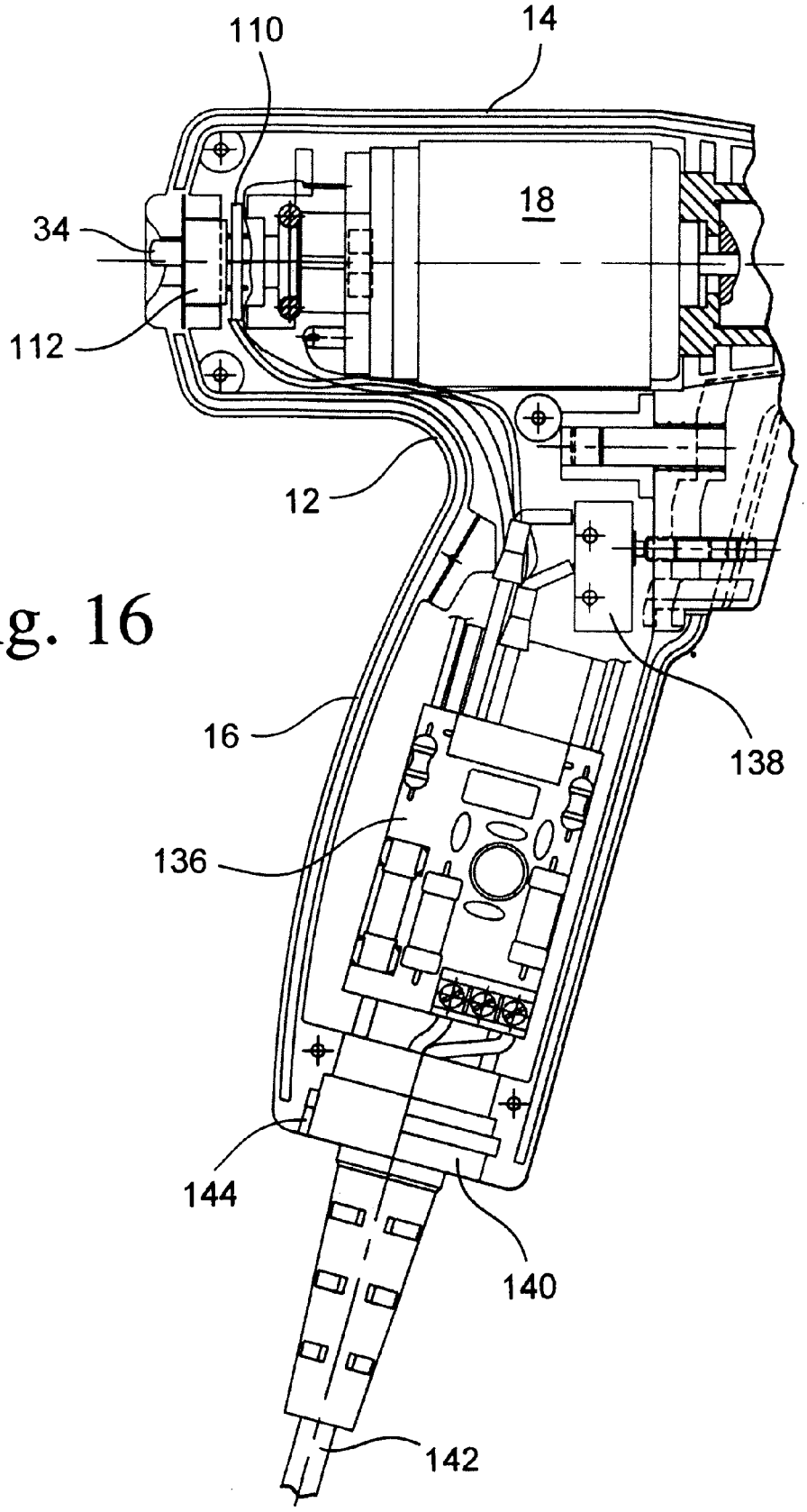
FIG. 16 is a partial side view similar to FIG. 1 showing the housing interior when the tool is manufactured for AC operation instead of battery operation.

FIG. 16 illustrates another feature of the invention, namely, configuring the gun handle 16 so that it is relatively simple to manufacture a tool for either battery operation or AC operation via a power line cord. FIG. 1 shows the tool interior made for battery operation. The positive terminal of the battery 32 is connected via wire 122 to the circuit board at 124 and also to a contact 126 at the trigger 30. The other half 128 of the contact is connected to one of the motor terminals at 129. The other of the motor terns is connected to the circuit board at 130. The negative side of the battery is connected to the circuit board at 134 via wire 132. As shown in the circuit schematic of FIG. 15, with reversing switch in position A, positive battery power is supplied to the motor's upper terminal, and with reversing switch in position B, negative battery power is supplied to the motor's upper terminal, reversing its rotation. When it is desired to manufacture the same tool but powered by AC power, the same housing 14 can be used. The terminals 126, 128 and the battery contacts are replaced by a second circuit board 136 connected to the part 138 which is now a simple on/off toggle switch, and a support structure 140 for a conventional AC line cord 142 is plugged into what previously was the support 144 for the battery. The second circuit board 136 in a conventional manner rectifies the AC line input. Several of the wire connections change (cf: FIGS. 1 and 16), but the changeover is remarkably simple and very inexpensive since the same mold can be used for both tool housings. Typically, the tool housings are of molded plastic. Most known hand tools are differently configured when manufactured for battery or AC operation.

It is understood that the circuit details are not critical and other arrangements can be chosen to achieve the function of allowing reversible motor rotation.

Among the advantages of the invention described herein are ease of operation as a wrap or unwrap tool which merely requires axially-repositioning of the movable sleeve 78 and operation of the reversing switch 34, protection against inadvertent activation of the reversing switch 34 by its mounting inside of a protecting ridge 118, quick-release and mounting of a bit/sleeve assembly by a small movement of a collet housing 50, and use of the same gun housing for fabrication of either a battery operated or an AC powered tool.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. In a tool for wrapping or unwrapping wire about a terminal, wherein the tool comprises a gun-type housing having a generally bullet-shaped body on top of a handle with a trigger mechanism, electric motor drive means within the housing for rotating a bit that orients the wire relative to the terminal within a sleeve, held against rotation, for feeding the wire to the bit, said sleeve when mounted in the tool holding the bit in driving relationship with the drive means, the improvement comprising:

(a) quick-release means mounted on the housing for rapid mounting and unmounting of a bit/sleeve combination, said quick-release means comprising:

(i) first means mounted on the housing for receiving in camming relationship sleeve holding second means, (ii) sleeve holding second means for loosely receiving and holding the sleeve and for gripping the sleeve, to prevent rotation when the bit is rotated, when the second means is placed in camming relationship with the first means, (iii) third means for selectively urging the second means into camming relationship with the first means between a first non-gripping position and a second gripping position, such that, when the third means is placed in the first non-gripping position, the bit and sleeve can be easily mounted on or unmounted from the tool, whereas, when the third means is placed in the second gripping position, the sleeve is tightly held within the tool while the bit is rotated;

(b) means for reversing the direction of rotation of the electric motor whereby the tool can be used for wrapping a wire about a terminal when a bit is rotated in a first direction, and the tool can be used for unwrapping a wire about a terminal when a bit is rotated in a second direction opposite to the first direction, said reversing means comprising an electric switch having an activator connected to a circuit connected to the electric motor such that, when the switch activator is in a first position, the electric motor is rotated in the first direction, and when the switch activator is in a second position, the electric motor is rotated in the second direction, (c) the bullet shaped body of said housing having a first end for receiving the bit and sleeve and a second end at the opposite end of the housing, said housing having at its second end an annular ridge projecting away from the housing and surrounding a recessed region, (d) said circuit being mounted within the housing, (e) said switch being mounted within the housing but with its activator external to and accessible from the housing but positioned within the recess region inside of the annular ridge such that the ridge extends further away from the housing end than does the switch activator and the switch activator is protected against accidental activation should the tool's second end come into accidental contact with a hard surface capable of activating the switch activator if it were not protected against such contact;

(f) said gun-type housing being of molded plastic, (g) the handle being configured such that it is capable of selectively supporting a battery and circuitry for battery operation of the motor or an AC power cord and circuitry for AC operation of the tool;

(h) a bit/sleeve combination mounted in the housing and connected to the drive means and capable of wrapping wire when the bit is rotated in a first direction as well as unwrapping wire when the bit is rotated in a second opposite direction about a terminal, said bit/sleeve combination comprising:

(i) a bit having at first end a bit face configured for wrapping a wire about a terminal and at a second end means for rotating the bit when connected to the drive means, said bit having at its first end positioned just back of its bit face an external helical groove capable of unwrapping a wire from a terminal, (ii) a first sleeve having at its first end a spout for directing a wire to the bit face when the first sleeve is in a first position where the first end extends slightly beyond the bit face, said first end covering the helical groove when the first sleeve is in its first position, (iii) means for positioning the first sleeve in its first position with its first end covering the helical groove when the bit/sleeve combination is to be used to wrap a wire, and for positioning the first sleeve in a second position with its first end moved rearward so as to expose the helical groove when the bit/sleeve combination is to be used to unwrap a wire.

2. A bit/sleeve combination capable of wrapping as well as unwrapping wire about a terminal, comprising:

(a) a bit having at a first end a bit face configured for wrapping a wire about a terminal and at a second end means for rotating the bit when connected to drive means, said bit having at its first end positioned just back of its bit face an external helical groove capable of unwrapping a wire from a terminal, (b) a first sleeve having at its first end a spout for directing a wire to the bit face when the first sleeve is in a first position where the first end extends slightly beyond the bit face, said first end covering the helical groove when the first sleeve is in its first position, (c) means for positioning the first sleeve in its first position with its first end covering the helical groove when the bit/sleeve combination is to be used to wrap a wire, and for positioning the first sleeve in a second position with its first end moved rearward so as to expose the helical groove when the bit/sleeve combination is to be used to unwrap a wire.

3. A bit/sleeve combination capable of wrapping as well as unwrapping wire about a terminal as claimed in claim 2, wherein the means of claim element (c) comprises an adaptor assembly, said adaptor assembly including a second sleeve surrounding a portion of the first sleeve and a portion of the bit and having a first end for preventing the bit from being withdrawn from the first sleeve and a second end for selectively gripping the first sleeve in its first or its second position.

4. A bit/sleeve combination capable of wrapping as well as unwrapping wire about a terminal as claimed in claim 3, wherein the adaptor assembly comprises means for gripping the first sleeve, said first sleeve having axially-positioned first and second means for cooperating with the means for gripping of the adaptor assembly for holding the first sleeve in its first or its second position.

5. A bit/sleeve combination capable of wrapping as well as unwrapping wire about a terminal as claimed in claim 4, wherein the means for gripping the first sleeve comprises an O-ring, and the first and second means of the first sleeve comprise axially-spaced grooves for receiving the O-ring.

6. In a tool for wrapping or unwrapping wire about a terminal, wherein the tool comprises a gun-type housing having a generally bullet-shaped body on top of a handle with a trigger mechanism, electric motor drive means within the housing for rotating a bit that orients the wire relative to the terminal within a sleeve, held against rotation, for feeding the wire to the bit, said sleeve when mounted in the tool holding the bit in driving relationship with the drive means, the improvement comprising:

(a) means for reversing the direction of rotation of the electric motor whereby the tool can be used for wrapping a wire about a terminal when a bit is rotated in a first direction, and the tool can be used for unwrapping a wire about a terminal when a bit is rotated in a second direction opposite to the first direction, said reversing means comprising an electric switch having an activator connected to a circuit connected to the electric motor such that, when the switch activator is in a first position, the electric motor is rotated in the first direction, and when the switch activator is in a second position, the electric motor is rotated in the second direction, (b) the bullet shaped body of said housing having a first end for receiving the bit and sleeve and a second end at the opposite end of the housing, said housing having at its second end an annular ridge projecting away from the housing and surrounding a recessed region, (c) said circuit being mounted within the housing, (d) said switch being mounted within the housing but with its activator external to and accessible from the housing but positioned within the recessed region inside of the annular ridge such that the ridge extends further away from the housing end than does the switch activator and the switch activator is protected against accidental activation should the tool's second end come into accidental contact with a hard surface capable of activating the switch activator if it were not protected against such contact;

(e) said gun-type housing being of molded plastic, (f) the handle being configured such that it is capable of selectively supporting a battery and circuitry for battery operation of the motor or an AC power cord and circuitry for AC operation of the tool;

(g) a bit/sleeve combination mounted in the housing and connected to the drive means and capable of wrapping wire when the bit is rotated in a first direction as well as unwrapping wire when the bit is rotated in a second opposite direction about a terminal, said bit/sleeve combination comprising:

(i) a bit having at a first end a bit face configured for wrapping a wire about a terminal and at a second end means for rotating the bit when connected to the drive means, said bit having at its first end positioned just back of its bit face an external helical groove capable of unwrapping a wire from a terminal, (ii) a first sleeve having at its first end a spout for directing a wire to the bit face when the first sleeve is in a first position where the first end extends slightly beyond the bit face, said first end covering the helical groove when the first sleeve is in its first position, (iii) means for positioning the first sleeve in its first position with its first end covering the helical groove when the bit/sleeve combination is to be used to wrap a wire, and for positioning the first sleeve in a second position with its first end moved rearward so as to expose the helical groove when the bit/sleeve combination is to be used to unwrap a wire.

* * * * *